US005156441A

United States Patent [19]

Byersmith et al.

[11] Patent Number: 5,156,441

[45] Date of Patent: Oct. 20, 1992

[54] CHAISE LOUNGE RECLINING CHAIR WITH AN INTERMEDIATE LEG SUPPORT MEMBER

[75] Inventors: Michael R. Byersmith, Millbury, Ohio; Larry P. LaPointe, Temperance, Mich.

[73] Assignee: La-Z-Boy Chair Company, Monroe, Mich.

[21] Appl. No.: 686,656

[22] Filed: Apr. 17, 1991

Related U.S. Application Data

[63] Continuation-in-part of Ser. No. 647,017, Feb. 1, 1991.

[51] Int. Cl.[5] ..... A47C 7/50

[52] U.S. Cl. ..... 297/423; 297/68; 297/75; 297/85; 297/219; 297/435

[58] Field of Search ..... 297/68, 75, 219, 423, 297/433, 435, 436, DIG. 7, 85, 218

[56] References Cited

U.S. PATENT DOCUMENTS

| | | | |
|---|---|---|---|
| 27,645 | 3/1860 | McGregor . | |
| 76,577 | 4/1868 | Zinn | 297/433 X |
| 78,304 | 5/1868 | Martin . | |
| 248,752 | 10/1881 | Huston | 297/78 X |
| 390,353 | 10/1888 | Ecker et al. | 297/436 X |
| 1,248,931 | 12/1917 | Schuman . | |
| 2,630,162 | 3/1953 | Rechler | 297/218 X |
| 2,664,942 | 1/1954 | Spear | 297/75 |
| 2,774,412 | 12/1956 | Luckhardt | 297/75 |
| 3,103,381 | 10/1963 | Schliephacke . | |
| 3,550,952 | 12/1970 | Ferguson . | |
| 4,367,895 | 1/1983 | Pacitti et al. | 297/83 X |
| 4,400,030 | 8/1983 | Maruzzo et al. | 297/219 |
| 4,410,213 | 10/1983 | Samson . | |
| 4,570,996 | 2/1986 | Rogers, Jr. . | |
| 4,669,778 | 6/1987 | Rogers, Jr. | 297/68 X |
| 4,790,599 | 12/1988 | Goldman | 297/68 X |
| 4,915,444 | 4/1990 | Rogers, Jr. . | |

FOREIGN PATENT DOCUMENTS

| | | | |
|---|---|---|---|
| 878022 | 9/1961 | United Kingdom | 297/75 |

*Primary Examiner*—James R. Brittain
*Assistant Examiner*—Milton Nelson, Jr.
*Attorney, Agent, or Firm*—Harness, Dickey & Pierce

[57] ABSTRACT

A chaise lounge recliner chair which incorporates an intermediate leg support member for providing support to the thighs and areas behind the knees of the legs of an occupant of the chair. The intermediate leg support member is connected to a portion of the seat of the recliner chair and a portion of the leg rest member of the chair. When the leg rest member is in an extended position the intermediate leg support member provides a normal slightly convex support surface. As the seat back of the chair is reclined, it causes the seat member to be extended outwardly which causes the intermediate leg support member to assume a pronounced convex surface. A plurality of elastic straps are further included and disposed between the seat and leg rest members to prevent the intermediate leg rest member from crowning downwardly relative to the chair frame when the leg rest member is in its extended position.

12 Claims, 12 Drawing Sheets

CHAISE LOUNGE RECLINING CHAIR WITH AN INTERMEDIATE LEG SUPPORT MEMBER

CROSS-REFERENCE TO RELATED APPLICATION

This application is a continuation-in-part of U.S. application Ser. No. 647,017, filed Feb. 1, 1991.

BACKGROUND OF THE INVENTION

The present invention relates to furniture and, more particularly, to an improved reclining mechanism for articles of furniture such as chairs, sofas and loveseats.

In general, most conventional reclining chairs employ a relatively complex recliner mechanism which is operatively interconnected between a movable chair frame and a stationary base assembly. Typically, the recliner mechanism has an intermediate carriage assembly provided for supporting the chair frame for translational (i.e. fore and aft) movement relative to the base assembly. In addition, the translational movement of the carriage assembly causes corresponding reclining movement of a seat assembly between an "upright" position and a fully "reclined" position. One example of such a reclining chair is shown and described in U.S. Pat. No. 4,367,895 and which is assigned to the common assignee of the present invention.

Reclining mechanisms typically generate a relatively large amount of frictional drag which must be overcome for smooth movement between the "upright" and "reclined" positions. In particular, lighter weight seat occupants must normally exert a deliberate leveraged thrust or force, in addition to pulling the actuator lever, for completely extending a leg rest assembly and/or moving the seat assembly to its "reclined" position. Moreover, it is often difficult for the seat occupant to return the seat assembly to the "upright" position from the fully "reclined" position due to the relatively large included angle between the seat member and the reclined seat back. As such, the seat occupant must exert a relatively large and deliberate leveraged force to return the reclined seat assembly to its full upright position.

Another drawback associated with many conventional recliners is that the leg rest assembly cannot be retracted to its "stowed" position from an extended or elevated position until after the seat occupant has completely returned the seat assembly to its fully "upright" position. Likewise, some reclining chairs do not permit independent actuation of the leg rest assembly during the entire range of reclining motion.

With further regard to the leg rest assembly of a conventional recliner, while the leg rest assembly typically provides sufficient support for the legs of the seat occupant, there are areas of the legs, primarily behind the knees and the thighs, which would benefit from even further, more direct support. While it is known to provide padding between the recliner seat and the footrest to give the appearance of a chaise lounge chair and provide some support to the mid-leg portions of an occupant, it would be advantageous if an intermediate variable support member in the form of an attached cushion was incorporated into the recliner. Such a support member would provide enhanced support for the upper portions of the legs, such as the backs of the thighs and knees, of the seat occupant when the leg rest member is in its extended position.

Such a support member as described above, when used with a reclining chair, would enable the chair to provide an occupant with increased degrees of cushioned support extending continuously from the upper back to the feet in a manner somewhat similar to a typical chaise lounge.

SUMMARY OF THE INVENTION

In accordance with the principles of the present invention, an improved reclining type article of furniture is disclosed which is designed to overcome the disadvantages typically associated with conventional reclining mechanisms. Therefore, one primary object of the present invention is to provide a reclining mechanism which eliminates the intermediate carriage assembly so as to significantly reduce the complexity, weight and cost of the reclining chair while providing improved comfort to the seat occupant.

It is yet another primary object of the present invention to provide an improved recliner having a leg support member coupled intermediate a seat portion and an extendable leg rest member of the recliner to provide variable support to the backs of the thighs and knees of an occupant of the recliner when the leg rest member is in its extended position.

It is an additional object of the present invention to provide a compact three-way recliner which permits use of loose cushions therewith. The three-way recliner is adapted to permit independent "reclining" movement of the seat back relative to the seat member, "tilting" movement of the chair frame relative to the base assembly, and actuation (i.e., extending and retracting) of the leg rest assembly. Tilt linkage means are provided for angularly pivoting (i.e. tilting) the entire chair frame about a horizontal axis relative to the base assembly upon actuation of the leg rest assembly for optimizing seating comfort. In addition, curved track means of the base assembly are adapted to tilt the entire chair frame upon reclining movement. As such, tilting movement due to reclining movement of the seat assembly and leg rest movement are independent of each other while being cumulative in nature.

It is another object of the present invention to reduce the input force exerted by the seat occupant for smoother operation of the reclining mechanism. As a related object, the improved reclining mechanism has incorporated various linkage and drive components designed for substantially reducing frictional losses in an effort to promote easier and smoother actuation. As such, the present invention provides a reclining chair wherein the weight of the person seated therein is utilized as the primary means for moving the seat assembly between the "upright" position and the "reclined" position.

In a preferred embodiment of the present invention, left and right wheeled bearing link assemblies are provided for directly interconnecting opposite sides of the chair frame to left and right channel-like tracks of the base assembly for permitting translational movement of the chair frame relative to the base assembly. Such translational movement of the chair frame coacts with a swing link mechanism interconnecting the seat assembly to the chair frame and a push link mechanism for causing "reclining" movement of the seat assembly relative to the chair frame. The seat assembly includes a seat back frame and a seat frame movably mounted on the chair frame and interconnected by the swing link mechanism for causing reclining movement of the seat assembly in response to pressure applied by the seat occupant. Furthermore, the pressure applied by the seat occupant acts to drive the push link mechanism for smoothly moving the chair frame during the reclining movement. In addition, the bearing link assemblies are operatively coupled to the tilt linkage means for causing independent "tilting" movement upon selective actuation of the leg rest assembly. Moreover, the bearing link assemblies are provided with adjustment means for permitting selective adjustment of the side-to-side relationship between the chair frame and the channel-like tracks for producing smoother and quieter translational movement therebetween.

The leg rest assembly is operated by the seat occupant rotating an actuator lever through a limited angle which, in turn, rotates a drive rod assembly for actuating the extensible leg rest pantograph linkages. An over-center toggle mechanism is provided to assist in extending and retracting the leg rest assembly and in retaining the leg rest assembly in its "stowed" position. Also, a detent mechanism is provided for yieldably holding the leg rest assembly in one of several different protracted positions. In addition, rotation of the drive rod assembly concurrently actuates the tilt linkage means for "tilting" the chair frame relative to the stationary base assembly while the included angle between the seat back and seat member is maintained substantially constant throughout the entire range of "tilting" movement.

In accordance with another feature of the present invention, forward movement of the chair frame relative to the base assembly for "reclining" the seat assembly also acts to compensate for rearward angular movement of the seat back so as to maintain a substantially constant clearance between the seat back and an adjacent wall surface. Furthermore, due to the reduced frictional drag of the improved recliner mechanism, it is not necessary for the seat occupant to apply additional leverage with his arms or feet to initiate the desired reclining movement. In addition, "tilting" of the chair frame in conjunction with movement of the leg rest assembly and reclining movement of the seat assembly contributes significantly to the ease and smoothness of operation while also providing an added increment of comfort and consumer satisfaction.

In another preferred embodiment, a recliner is disclosed which incorporates as intermediate leg support member connected inbetween portions of seat and leg rest members of the recliner. The intermediate leg support member is preferably in the form of a cushion which is preferably sewn to portions of the seat and leg rest members. The intermediate leg support member provides significant variable support to portions of the backs of the thighs and knees of the seat occupant when the leg rest member is in its extended position.

Additional objects, advantages, and features of the present invention will become apparent from the following description and appended claims, taken in conjunction with the accompanying drawings.

DETAILED DESCRIPTION OF THE INVENTION

In accordance with the teachings of the present invention, an improved reclining mechanism and leg support system for use in single person (i.e., chairs) and multi-person (i.e., sofas and loveseats) articles of furniture is disclosed. The reclining mechanism of the present invention is a "three-way" mechanism which can be actuated to independently "recline" a seat back relative to a seat member or move a leg rest assembly between retracted and extended positions. When a person sits in a chair equipped with the improved reclining mechanism, the leg rest assembly is extended by selectively rotating an actuator lever. In addition, substantially concurrent "tilting" movement of the entire chair frame is provided upon such rotation of the actuator lever. Moreover, a full range of independent "reclining" movement of the seat back relative to the seat member is possible regardless of the operative position of the leg rest assembly between its fully "retracted" and "extended" positions. This reclining movement also produces substantially concurrent "tilting" movement of the chair frame. Therefore, tilting due to reclining movement of the seat back and tilting due to movement of the leg rest assembly are automatic, independent and cumulative in nature. The reclining mechanism of the present invention is relatively compact in size to permit use of loose upholstered cushions which is essential for marketing all styles of chair, sofa or loveseat furniture. Finally, the reclining mechanism of the present mechanism provides forward extension of the seat member when the furniture article is in the reclined position. This forward extension in combination with the particular type of cushion and leg rest arrangement disclosed provides a unique leg support system that will be more fully described below.

Figure 1A:
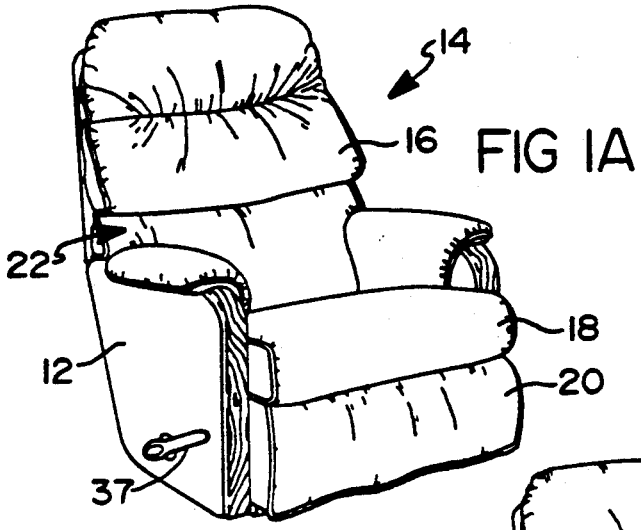
FIGS. 1A through 1D are perspective views of an exemplary upholstered reclining chair having an extensible leg rest assembly shown in various operative positions.
Figure 1B:
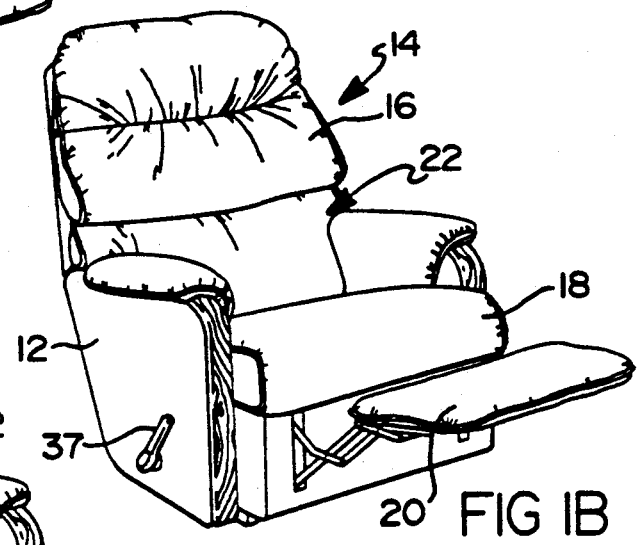
Figure 1C:
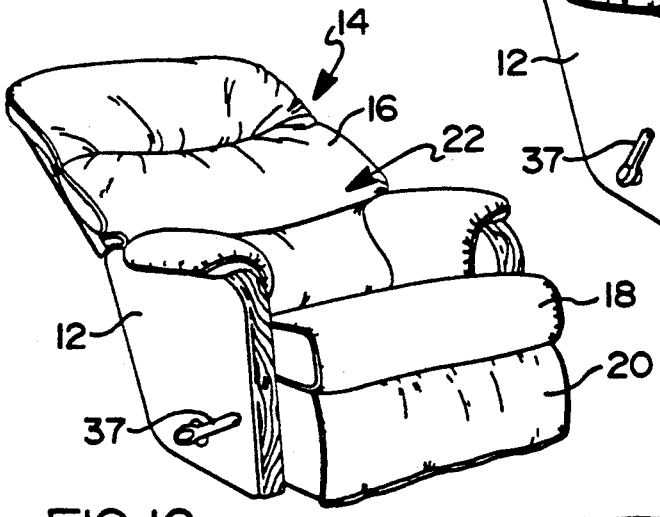
Figure 1D:
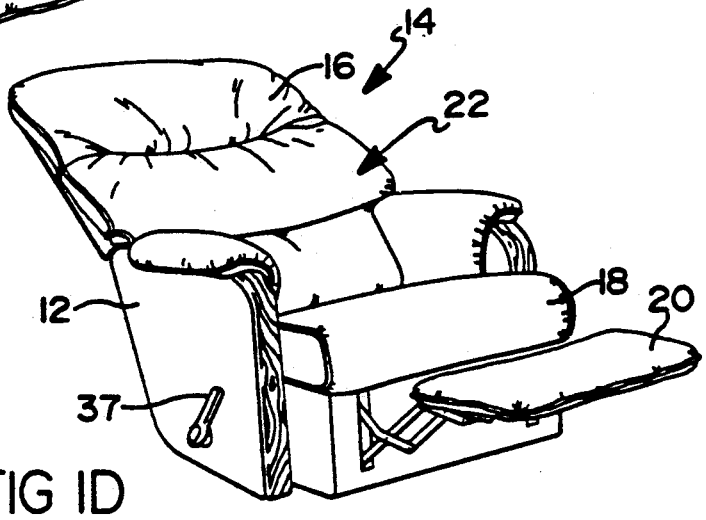

With particular reference now to the drawings, the operative relationship of an improved reclining mechanism 10 of the type adapted to support a prefabricated chair frame 12 will now be described. More particularly, FIG. 1A depicts an exemplary reclining chair 14 having its seat back 16 and seat member 18 shown in a fully "upright" position for permitting an occupant to enjoy conventional seating. FIG. 1B illustrates reclining chair 14 in the upright position with its associated leg rest assembly 20 being protracted to an elevated position. FIG. 1C illustrates chair 14 having seat back 16 moved to a "reclined" position relative to seat member 18 while leg rest assembly 20 is stowed in its retracted position. As will be described, seat back 16 and seat member 18 define a seat assembly 22 which is supported for reclining movement on chair frame 12. Reclining movement of seat assembly 22 is accomplished by the seat occupant deliberately applying pressure to seat back 16 such that a swing linkage mechanism causes seat member 18 to move forwardly and upwardly to maintain seating comfort while the included angle increases therebetween. All this is reversed, and chair 14 returned to its upright position upon deliberate application of rearward pressure to seat assembly 22 or, more simply, if the seat occupant leans forward to remove pressure from seat back 16. Finally, FIG. 1D depicts chair 14 in a reclined position with its respective leg rest assembly 20 extended. As will be described hereinafter in greater detail, movement of leg rest assembly 20 and/or reclining movement of seat assembly 22 cause corresponding tilting movement of chair frame 12 relative to the floor.

Figure 2:
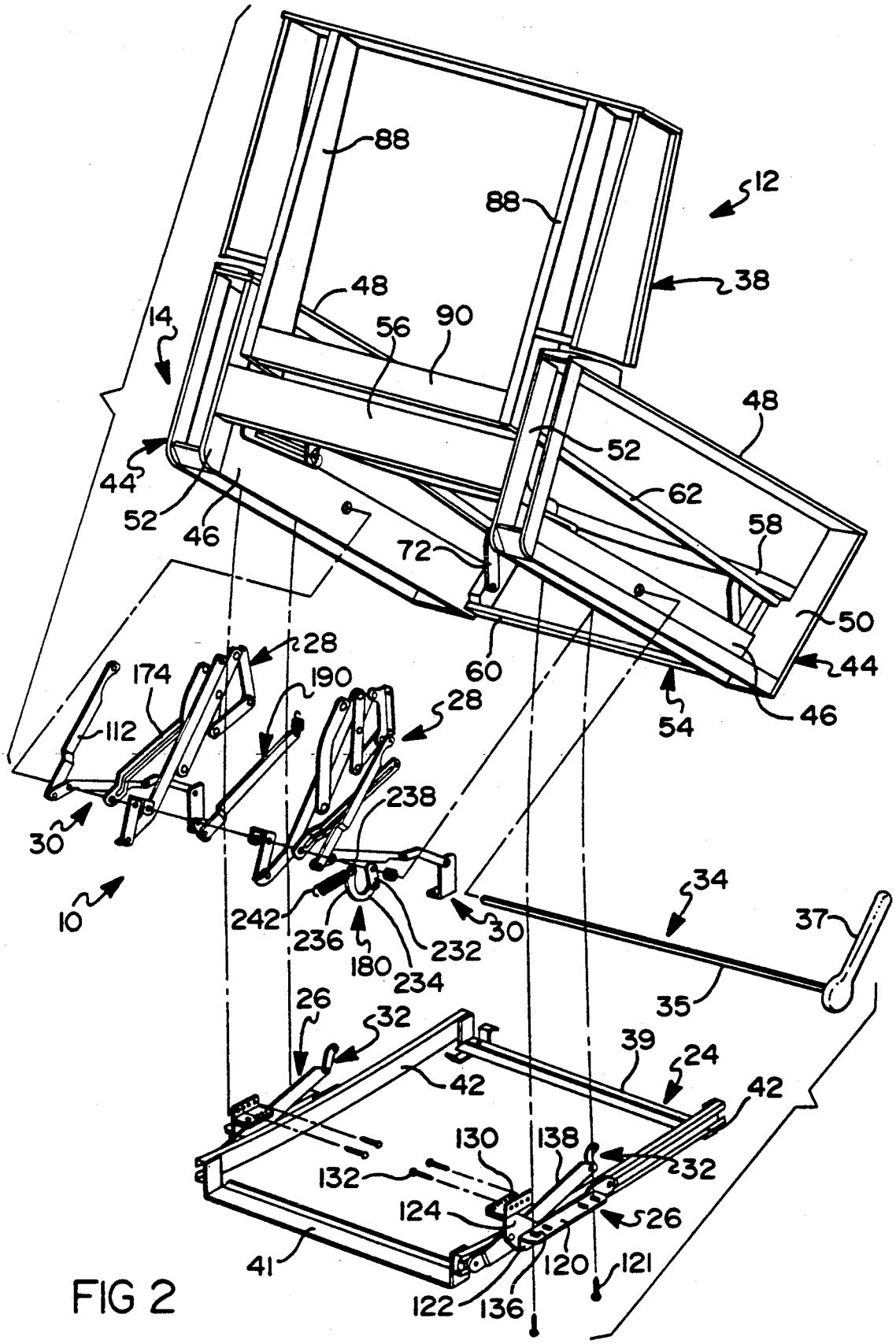
FIG. 2 is an exploded perspective view of the recliner chair of FIG. 1 with upholstery, springs, and other various parts removed, and which is partially disassembled for clarity, showing means for simply interconnecting the reclining mechanism to the chair frame.

With reference now to FIG. 2, an exploded perspective view of chair 14 is shown, with upholstery, padding, springs, etc. removed. In general, reclining mechanism 10 is shown to include a unitized base assembly 24, left and right bearing link assemblies 26 operatively interconnecting chair frame 12 to base assembly 24 for translational (i.e. fore and aft) movement, left and right pantograph leg rest linkage mechanisms 28, left and right push link mechanisms 30, tilt linkage means 32, and a drive assembly 34 for selectively actuating leg rest linkages 28 and tilt linkage means 32. More specifically, drive assembly 34 is shown to include an elongated square drive rod 35 supported within chair frame 12 and having a handle portion 37 provided adjacent an exterior side arm portion of chair 14 that can be easily reached by a person seated therein for convenient actuation thereof. However, it will be appreciated that other suitable manually operable release means known in the art, such as a push-button cable release or an concealed interior mounted actuator lever, can be readily incorporated into improved reclining mechanism 10 of the present invention.

Figure 5:
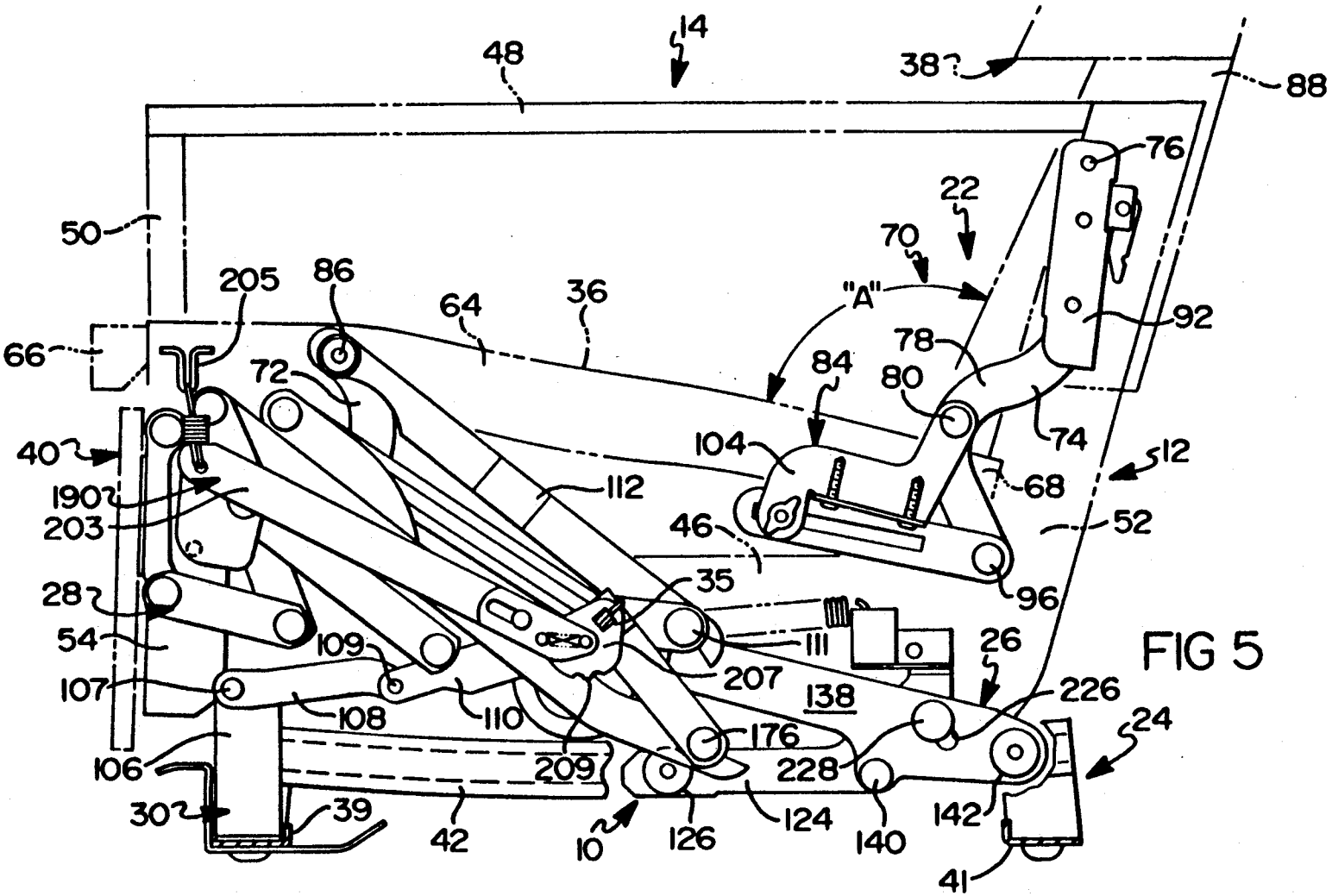
FIG. 5 is a partial schematic side view illustrating the reclining chair in an "upright" position.

With continued reference to FIG. 2, chair frame 12 is shown to be configured for retaining reclining mechanisms 10 substantially therein. As best seen in FIG. 5, various components of chair 14, such as chair frame 12, seat frame 36, seat back frame 38 and leg rest frame 40 are each constructed in a manner which enables them to support springs, padding, upholstery, etc., in order to complete a decorative and stylish chair 14 for use in the home. Preferably, these components are made of numerous wood rails that are fixedly secured together by suitable fasteners, such as dowels, staples, nails and screws, and which may be reinforced at critical joints by metal reinforcement plates or brackets and/or wood corner blocks in a known manner.

Unitized base assembly 24 forms a rigid rectangular frame defined by front and rear cross bars 39 and 41, respectively, secured to opposite ends of left and right metal channel-shaped tracks 42. Tracks 42 are outwardly facing and slightly curved relative to the floor and provide means for movably supporting left and right bearing link assemblies 26 so that they can move back and forth between front and rear cross bars 39 and 41. Base assembly 24 is adapted to be placed directly on the floor so as to eliminate the use of a heavy wooden base support typically used in most conventional reclining chairs. In addition, bearing link assemblies 26 are adapted to carry chair frame 12 so as to transfer substantially all loading from chair frame 12 and seat assembly 22 into base assembly 24.

As best seen in FIG. 2, chair frame 12 includes opposite side (i.e. left and right) frame members 44 in the form of rigid, roughly rectangular frames defined by relatively horizontal bottom members 46 and by relatively horizontal top members 48 which also function as chair arms. Each side frame 44 also includes a front post 50 which preferably has at least a lower portion substantially perpendicular to the floor. In addition, each side frame 44 has an inclined rear post member 52 such that front and rear posts 50 and 52, respectively, are rigidly secured to top and bottom horizontal members 44 and 46 respectively. The left and right hand side frames 44 are rigidly interconnected to form chair frame 12 by a front cross brace structure 54 and the rear cross brace member 56. The structure of front cross brace 54 comprises horizontal upper and lower cross pieces 58 and 60, respectively. A central wood post 62 is also shown for rigidly uniting front and rear posts 50 and 52. However, it is to be understood that chair frame 12 is merely exemplary in nature and that any suitable chair frame structure can be used with reclining mechanism 10.

Seat frame 36 is supported on chair frame 12 and is located between side frames 44 at a suitable distance between chair arms 48. Seat frame 36 is a rigid rectangular structure having left and right hand side bars 64 which are rigidly secured to opposite ends of front and rear cross pieces 66 and 68, respectively. Seat frame 36 is supported for movement on chair frame 12 by means of a swing linkage mechanism 70 for causing seat frame 36 to move substantially horizontally and slightly up or down, depending on whether seat frame 36 moves to the front (during reline) or to the rear (on return to upright). Swing linkage mechanism 70 includes left and right hand front swing links 72. More particularly, front swing links 72 are J-shaped members having their top ends pivotally connected to seat side bars 64 such that loading on seat frame 36 passes into front swing links 72. The lower end of J-shaped front swing links 72 are pivotally connected to a portion of front cross brace structure 54. Linkage mechanism 70 also includes left and right hand rear swing links 74 which extend vertically well above the level of seat frame 36 along side rear posts 52 of chair frame side frames 44 to which they are pivotally connected just below chair arms 48 about pivot point 76. A forwardly offset intermediate section 78 of rear swing links 74 is pivoted about pivot point 80 to an upstanding post section 82 of an angle seat bracket 84 having a horizontal flange securely fixed (such as by wood screws 85) to the underside surface of seat side bars 64 in relatively close proximity to the back end of seat frame 36. As such, loading on the rear of seat frame 36 passes from seat brackets 84 and pivots 80 into rear swing links 74 as tension in links 74 which is transferred by way of pivot 76 into chair frame 12. Thus, the rear of seat frame 36 moves much like a controlled pendulum on and below upper pivots 76 while the front of seat frame 36 swings to and fro above and on front pivot 86.

The primary means of moving rear swing links 74 is the application of pressure against seat back frame 38 above the level of pivot point 76, as when the seat occupant leans backward in chair 14. This action causes seat back frame 38 to pivot backwardly for causing rear swing links 74 to swing forwardly for initiating rolling forward movement of bearing link assemblies 26, and in turn, chair frame 12 in a manner to be described in greater detail hereinafter.

As is known, seat back frame 38 is also in the form of a rigid relatively rectangular assembly that includes right and left hand side members 88 and appropriate cross pieces, such as lower cross piece 90. Seat back frame 38 is removably mounted on the upper part of rear swing link 74 by means of slide brackets 92 secured at suitable locations on side members 88. A preferred form of slide brackets 92 for this type of mounting is shown and described in U.S. patent application Ser. No. 07/621,239 filed Nov. 30, 1990 and assigned to the common assignee of the present invention. More particularly, slide brackets 92 are channel-shaped to provide an interior track that slidably receives rear swing links 74 therein. When slide brackets 92 are mounted on rear swing links 74, seat back frame 38 is, in effect, an extension of rear swing links 74 above pivot points 76. As such, seat back frame 38 can be pivoted about pivots 76 for acting as a lever arm for causing relatively easy angularly movement of rear swing links 74. The force required for causing such movement, and thus fore and aft movement of chair frame 12, is preferably selectively adjustable via frictional resistance means shown in the form of a multiple layer left and right friction link members 94.

Friction links 94 have one end pivoted at 96 to a lower portion 98 of each rear swing links 74 and have an elongated slot 100 which receive a hand-adjustable spring-biased wing nut 102 and washer means (not shown) mounted on a downwardly extending forward arm 104 of seat brackets 84. As will be appreciated, the frictional resistance of links 94 to sliding movement of wing nut 102 in slot 100 and thus to pivotal movement of rear swing link 74 can be selectively adjusted by tightening wing nut 102 to suit the specific user of the chair. While not shown, spring means may be attached between forward extension 104 of seat brackets 84 and rear cross member 56 of chair frame 12 for normally biasing seat assembly 22 so as to assist in maintaining the "upright" included angle "A" between seat member 18 and seat back 16.

Left and right push link mechanisms 30 are provided for causing translational "fore and aft" movement of bearing linkage assemblies 26 and, in turn, chair frame 12 relative to base assembly 24 in response to the pressure applied by the seat occupant to seat back 16. In general, push linkage mechanisms 30 are interconnected between front cross bar 39 of base assembly 24 and pivots 86 at the forward portion of seat frame 36. More particularly, base brackets 106 extend vertically from front cross member 39 of base assembly 24. A first end of lower push links 108 are pivotally connected at pivot 107 to an upper end of base brackets 106. The opposite end of lower push links 108 are pivotally connected at pivots 109 to a first end of drive rod swing links 110 which are journally supported on drive rod 35. The opposite end of drive rod swing links 110 are pivotally connected at pivot 111 to the lower end of offset upper pull links 112, the upper ends of which are pivotally connected at pivot points 86 to the respective side bars 64 of seat frame 36. Preferably, drive rod swing links 110 have a central aperture through which a spacer sleeve 114 (FIG. 3) is disposed and which is concentrically supported on square drive rod 35. Thus, square drive rod 35 fixes the longitudinal position of drive rod swing links 110 and upper pull links 112 but is independently operable with respect to angular movement thereof. As such, when pressure is applied by the seat occupant to move between the FIG. 5 "upright" position and the FIG. 6 "reclined" position, push link mechanisms 30 cause corresponding fore and aft translational movement of chair frame 12 via movement of bearing linkage assemblies 26 within tracks 42. In addition, the slightly "down-hill" curvature of tracks 42 cause chair frame 12 to tilt relative to the floor upon translational movement thereof.

For purposes of clarity, the term "tilting" refers to angular movement of chair frame 12 and, in turn, seat assembly 22 about a horizontal axis relative to stationary base assembly 24. Such "tilting" movement occurs substantially concurrently with protraction of leg rest linkages 28 via selective rotation of actuator lever 37 by the seat occupant and/or upon reclining movement of seat assembly 22. The term "reclining" refers generally to the angular movement of seat assembly 22 relative to chair frame 12 and, more particularly, to the relative angular movement of seat back 16 with respect to seat member 18 via swing linkage mechanism 70 for increasing the included angle therebetween from a minimum "A" (i.e. upright) to a maximum "B" (i.e. reclined). Moreover, the present invention is designed to permit the seat occupant to select and maintain virtually any desired reclined position within the range of reclining movement between the included angles "A" and "B".

With particular reference now to FIGS. 3 through 9, the primary components of reclining mechanism 10 which produce the above-noted movement characteristics will now be described in more detail. As noted, reclining mechanism 10 includes left and right wheel bearing link assemblies 26 provided for movably supporting chair frame 12 for longitudinal "fore and aft"

movement relative to tracks 42 of stationary base assembly 24. Moreover, the fore and aft movement of chair frame 12 causes substantially simultaneous corresponding reclining movement of seat assembly 22 and tilting movement of chair frame 12. In addition, wheel bearing link assemblies 26 are operatively coupled to tilt linkage means 32 for causing independent tilting movement of chair frame 12 upon corresponding actuation of leg rest assembly 20 via rotation of drive rod 35. As will be appreciated, upon raising leg rest assembly 20 to an intermediate position, tilt linkage means 32 only produces a proportional amount of tilting movement.

In general, left and right bearing link assemblies 26 are mirror-imaged wheeled assemblies disposed respectively for rolling movement in left and right tracks 42 of base assembly 24. Preferably, tracks 42 are aligned in parallel relationship and are slightly downwardly curved from back to front to generate a gravity-assisted "down-hill" rolling movement of the wheeled unit therein. More specifically, bearing link assemblies 26 each include an angled bracket 120 adapted to be securely affixed directly to the bottom edge surface of horizontal bottom members 46 of chair frame 12 such as by wood screws 121. Angled brackets 120 include a downwardly extending flange 122 connected to a bearing link member 124 having a forward wheeled rolling unit 126 supported thereon and which is rollingly disposed within tracks 42. The upper rear end of bearing link 124 has a right-angled flange 127 having at least one elongated slot 128 provided for permitting a secondary mounting bracket 130 to be adjustably mounted thereto. Secondary mounting bracket 130 is provided for securely attaching bearing link 124 to an inner vertical surface of horizontal bottom members 46, such as by wood screws 132. Accordingly, elongated slot 128 on bearing link flange 126 and slots 136 in angled bracket 120 permit selective side-to-side adjustment of bearing link assemblies 26 to compensate for manufacturing tolerances in base assembly 24 and/or chair frame 12. A pivot lever 138 is pivotally connected to bearing link 124 and angle bracket 120 about pivot point 140. More particularly, pivot lever 138 includes a second rear wheeled unit 142 rolling disposed in tracks 42 with the opposite end of pivot levers 138 secured to respective left and right "tilt" linkage means 32, the structure and operation of which will be described hereinafter.

Figure 6:
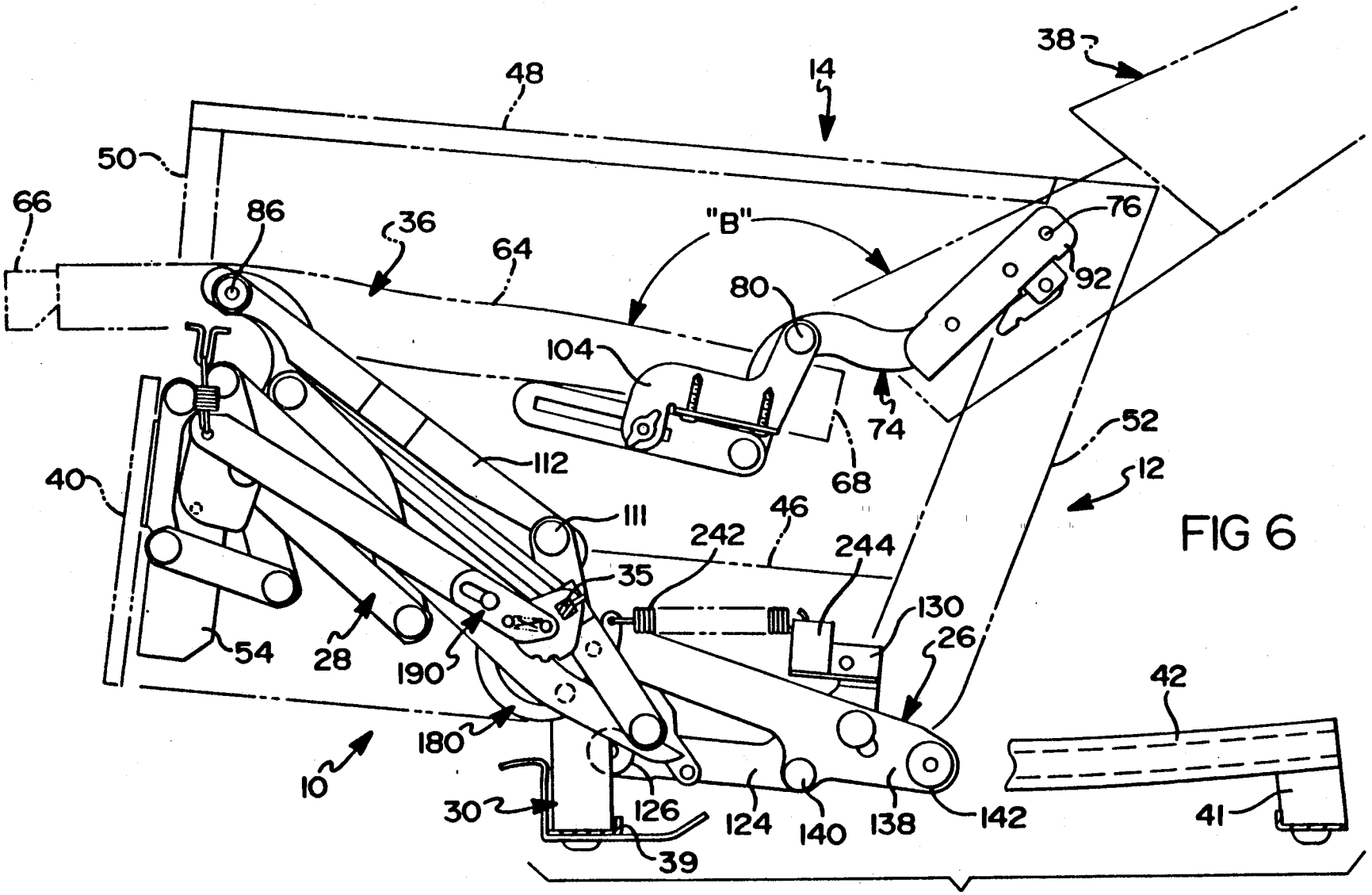
FIG. 6 is a side view, similar to FIG. 5, illustrating the reclining chair in a fully "reclined" and "tilted" position.
Figure 7:
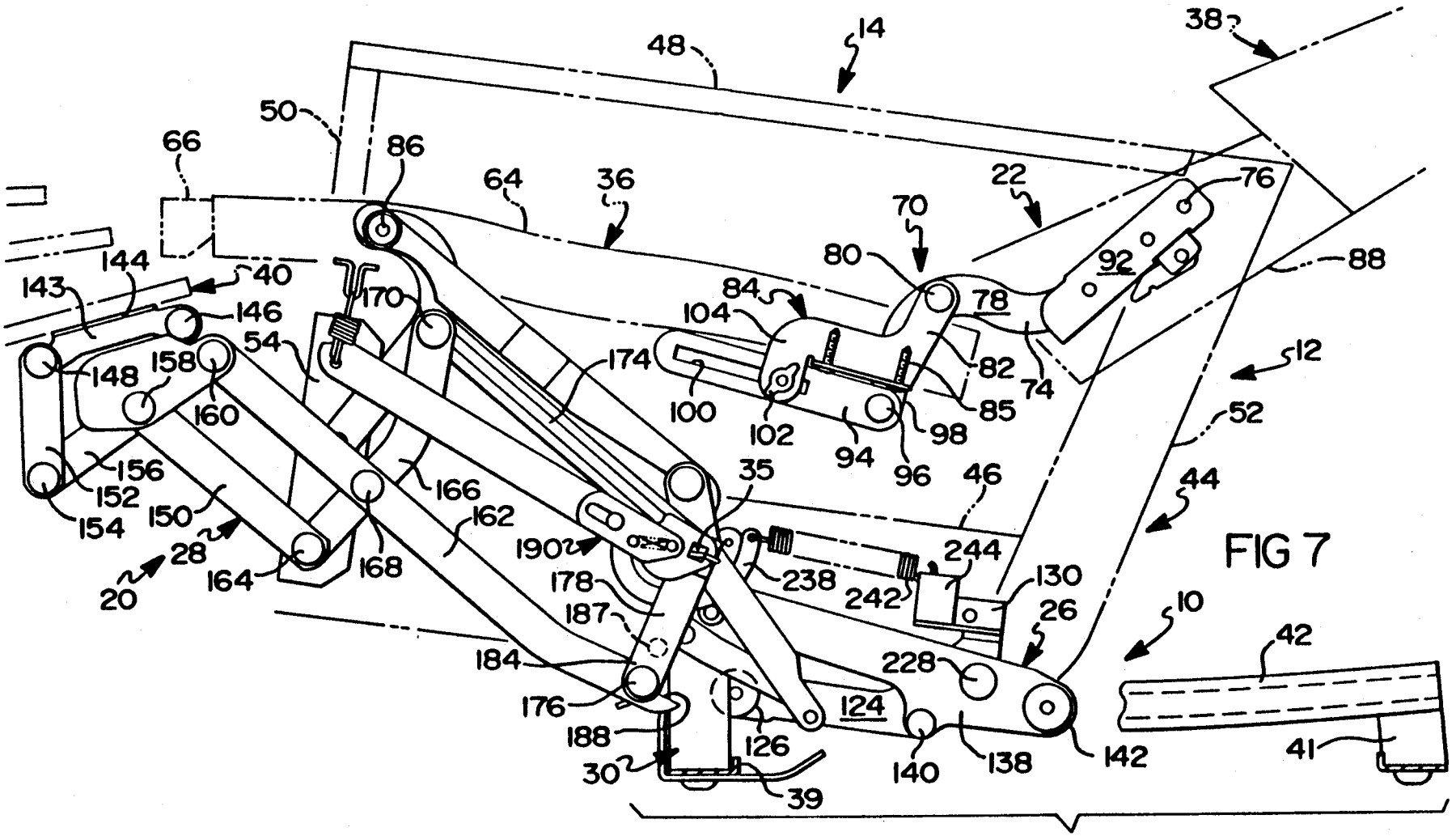
FIG. 7 is a side view, similar to FIG. 6, with the leg rest assembly in an extended position wherein the chair frame is further "tilted" relative to the base assembly.
Figure 8:
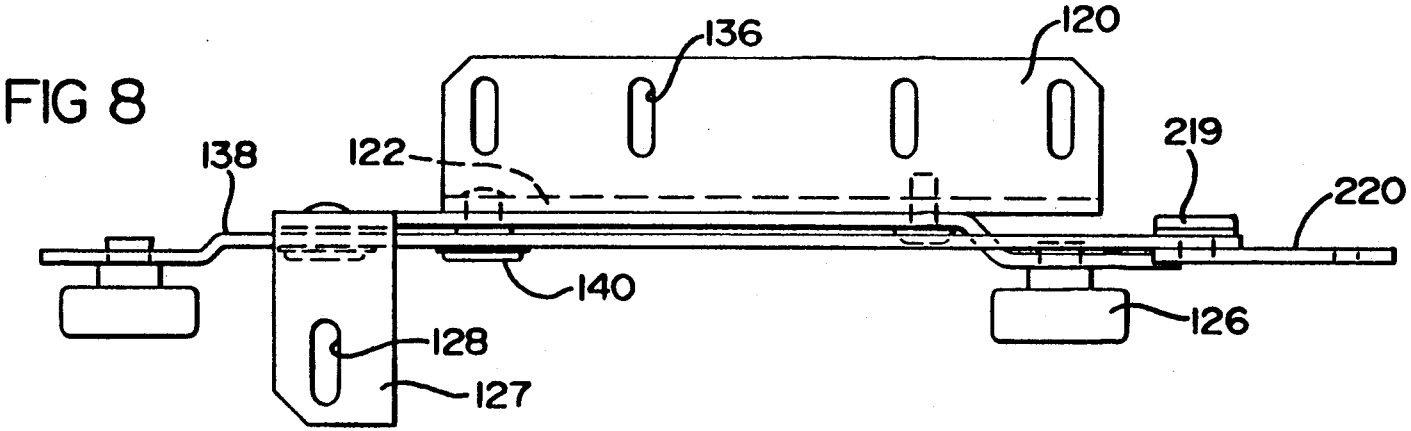
FIG. 8 is an enlarged plan view of the left-hand bearing link assembly shown in FIG. 3.
Figure 9:
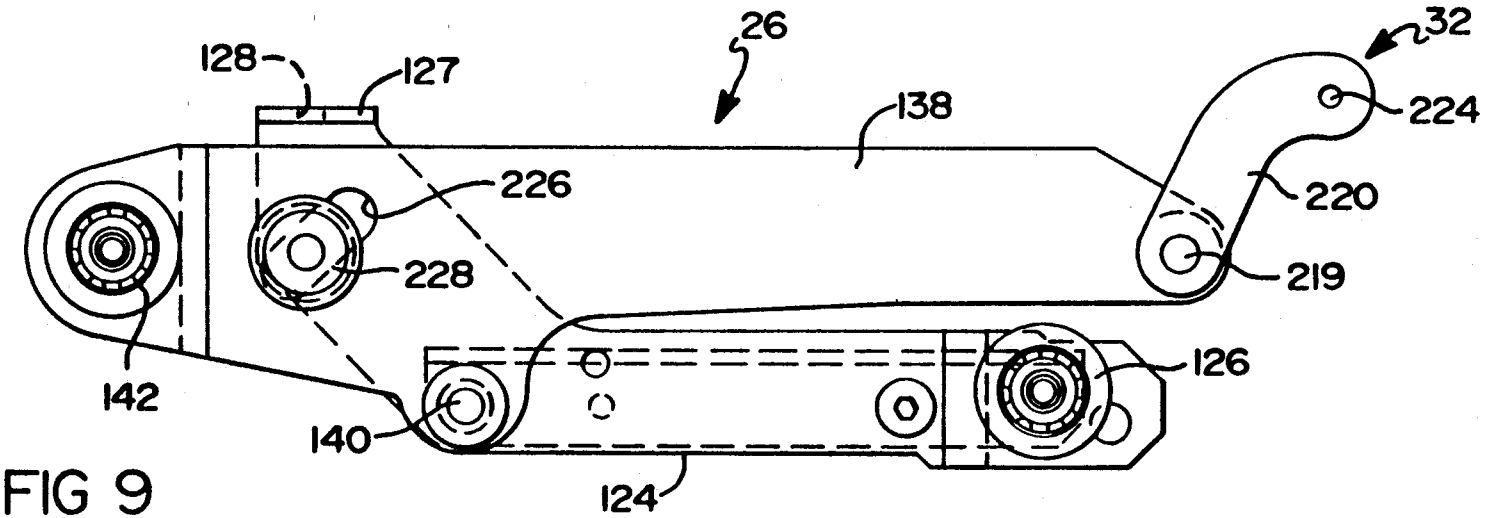
FIG. 9 is a side view of FIG. 8.

With particular reference now to FIGS. 5 through 7, leg rest assembly 20 is shown to include frame board 40 having an outer surface that is padded and upholstered so that finished chair 14 will be seen as in FIG. 1. Frame board 40 is supported and moved by identical left and right hand pantograph linkages 28. Pantograph linkages 28 are substantially identical in function and structure to that shown in FIG. 9 of U.S. Pat. No. 4,367,895. However, for a better understanding of their operation, a brief description is included herein. More particularly, frame board 40 has an angled bracket 143 secured to its bottom face 144 for each pantograph linkage 28 whereby board 40 is pivotally connected at a rear pivot 146 and a front pivot 148 to one end of board links 150 and 152, respectively, of pantographs 28. The opposite end of front board link 152 is pivoted at 154 to an end of a connector link 156 which, in turn, is centrally pivoted at 158 to a portion of rear board link 150. The other end of connector link 156 is pivoted at 160 to a top end of a long support link 162. The other end of rear board link 150 is pivoted at 164 to one end of a curved link 166 which is pivoted at a central pivot 168 to a central portion of long support link 176. The other end of curved link 166 is pivotally connected at pivot 170 to a front support bracket 172 (FIGS. 3 and 4) mounted to chair frame front cross member 58. Ribbed offset lateral support members 174 extend from square drive rod 35 to pivot 170 to provide lateral support and maintain the desired spacing between left and right pantograph mechanisms 28.

Another point of support is pivot 176 at the curved bottom end of long support link 162 which connects support link 162 to a first end of a drive link 178, the other end of which has a square aligned hole through which square drive rod 35 extends such that drive link 178 is driven by angular movement of drive rod 35. Thus, rotation of drive rod 35 turns drive link 178 which acts through pivot 176 to move long support link 162. Such movement of support link 162 causes curved link 166 to swing about fixed pivot 170 by virtue of pivot connection 168 that curved link 166 has with long support link 162. The action of link 166 swinging about fixed pivot 170 acts to move rear board link 150 outwardly and upwardly. In addition, pivot 169 at the top end of long support link 162 causes connector link 156 to swing about pivot 158 such that front board link 152 is also moved outwardly and upwardly. This extensible action takes place simultaneously with both the left hand and right hand pantograph linkage mechanism 28 when there is sufficient angular rotation of drive rod 35 via handle 37. As such, the effect is to move frame board 40 between its stowed vertical position (FIG. 5) and one of its elevated protracted position (FIG. 7).

Figure 3:
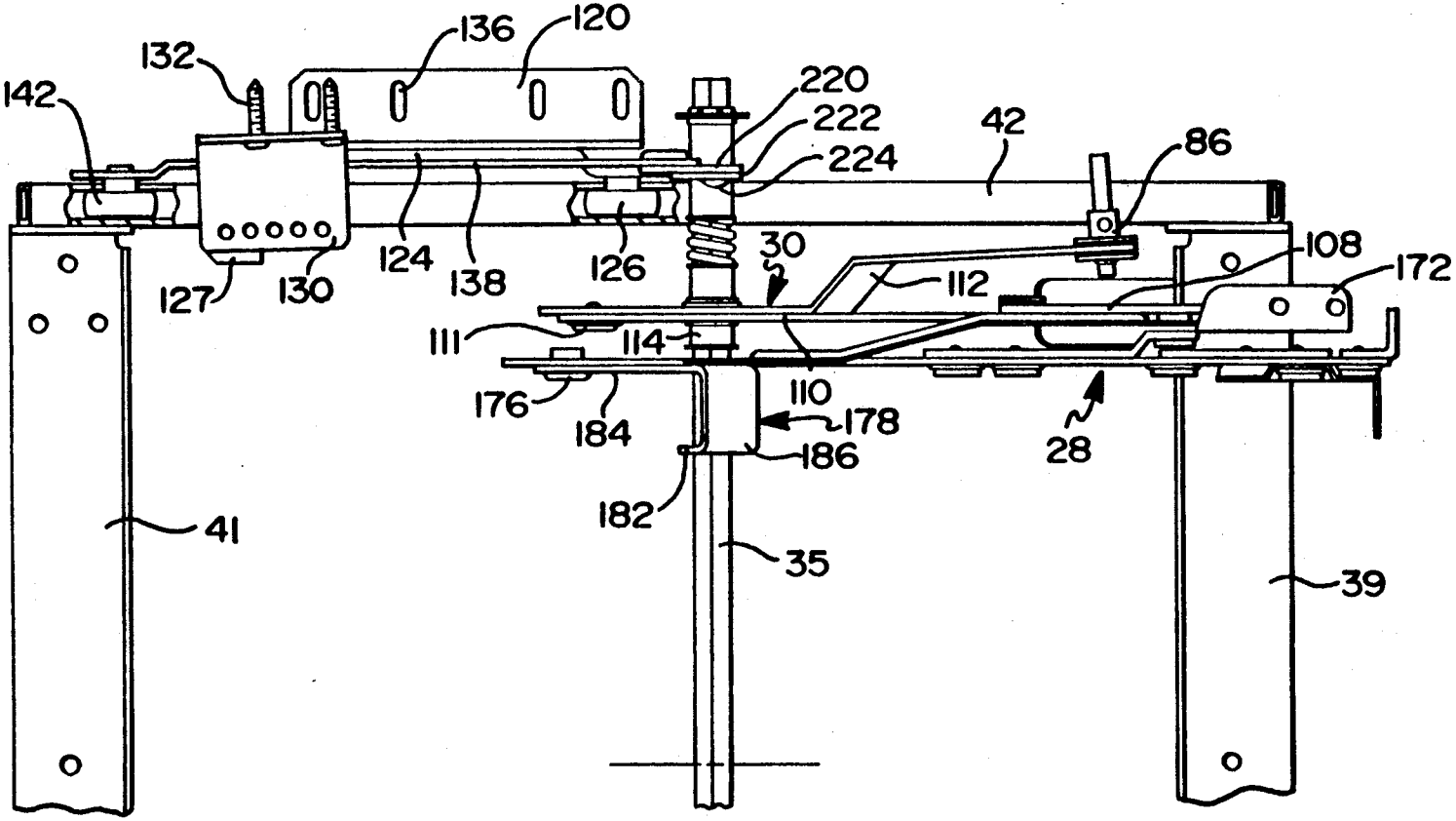
FIG. 3 is a plan view of a left-half portion of the recliner mechanism of FIG. 2.
Figure 4:
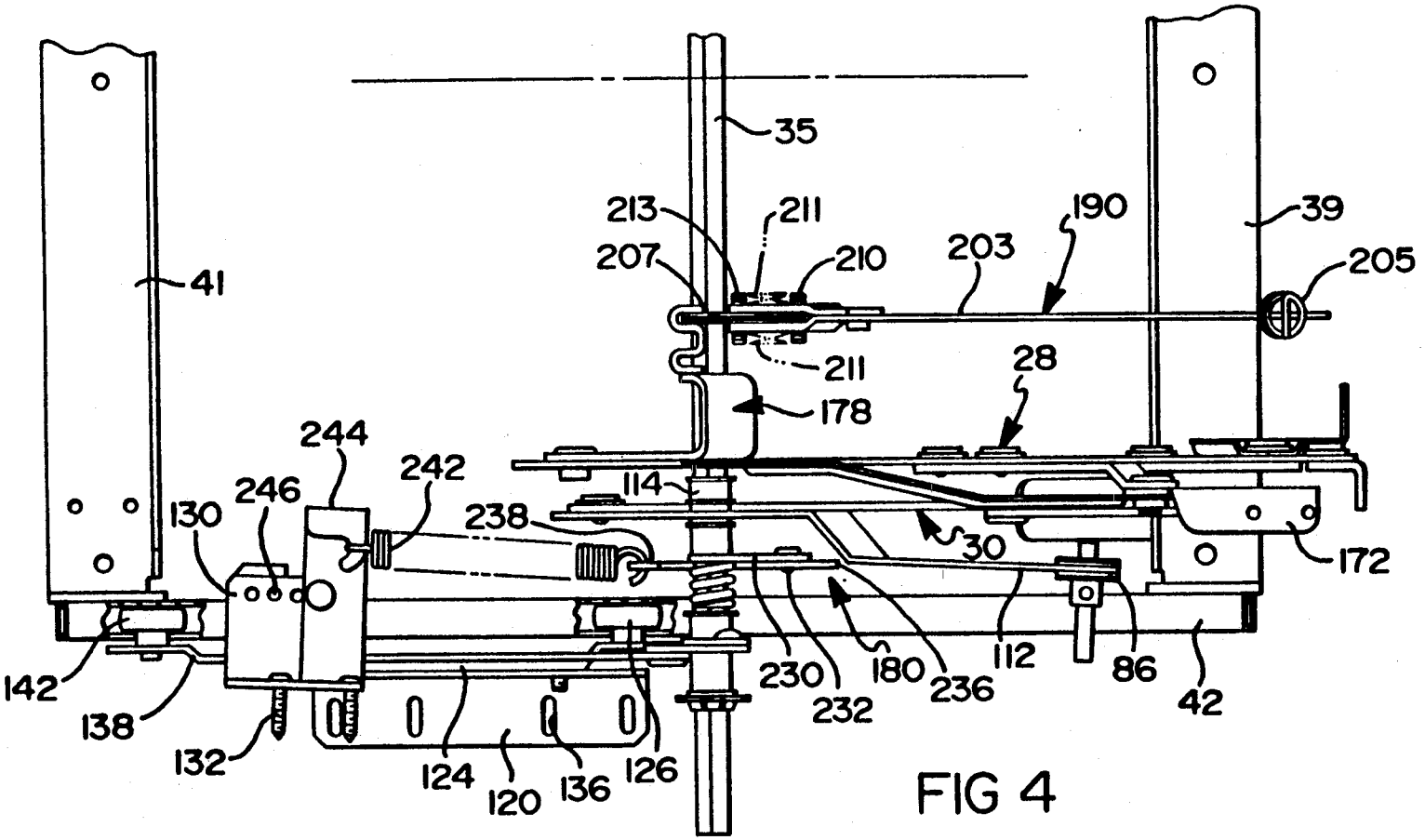
FIG. 4 is a plan view of a right-half portion of the recliner mechanism of FIG. 2.

As best seen in FIGS. 3 and 4, drive link 178 is generally U-shaped having parallel short and long legs 182 and 184, respectively, joined by a base 186. Both legs have square aligned holes in them through which the square drive rod 35 extends. In the fully extended horizontal position of leg rest assembly 20, a cold deformed stop tab 186 on long leg 184 contacts a stop shoulder 188 formed on the lower end of long support link 162 when long leg 184 and link 162 are almost in relatively collinear alignment. Due to engagement of stop tab 186 and stop shoulder 188, pantograph linkages 28 cannot go over-center such that leg rest frame 40 is held in the protracted position. A ratchet type detent mechanism 190 interconnects drive rod 35 and front structure 56 of chair frame 12 for providing various intermediate lockable protracted positions for leg rest 20 (shown in phantom in FIG. 7).

The structure of ratchet mechanism 190 includes an inclined link 203 which is suspended at its front end from upper cross piece 58 of chair frame 12 by a tension spring hanger assembly 205. The other end of link 203 is bifurcated to receive a sector-shaped plate member 207 that is mounted by way of a square hole on drive rod 35 so as to rotate therewith. Rachet plate 207 has specially shaped recesses 209 in its outer periphery which act as ratchet means cooperating with a floating detent pin 210 carrier by the bifurcations and urged into recesses 209 by tension springs 211 anchored on a pivot pin 213 between plate 207 and link 203. When drive rod 35 is rotated to operate leg rest assembly 20, plate 207 is also rotated to expose different recesses 209 to pin 210 depending upon the degree of rod rotation and the elevation. When pin 210 is lockingly biased into one of recesses 209, leg rest assembly 20 is yieldably held in an elevated position against inadvertent angular movement by mechanism 190. Spring assembly 205 accommodates relative movement between link 203 and cross piece 58 due to movement of pin 213 upon rotational plate 207. Leg rest assembly 20 can only be returned to its stowed position from an intermediate position by fully protracting leg rest 20. Thereafter, reverse rotation of handle 37 cause pantograph linkages 28 to return to the FIG. 5 stowed condition.

As noted, reclining mechanism 10 is confined below seat frame 32 with tracks 42 being an integral portion of base assembly 24. In this manner, the wooden bottom support rails typically incorporated into conventional reclining systems have been eliminated. Therefore, an overall reduction in the height of recliner 10 permits use of loose cushions removably installed on top of seat frame 36. In addition, reclining mechanism 10 is designed to cause less upward angular movement of seat frame 36 than conventional recliners upon forward "reclining" motion thereof as well as during "tilting" movement for significantly reducing the effort required for the seat occupant to return seat assembly 22 to the upright position.

According to the present invention, selective angular movement of drive rod 35 about its axis causes actuation of leg rest assembly 20 and "tilting" movement of chair frame 12. In addition, the weight of the seat occupant and the center of gravity of seat assembly 22, defined by the orientation of front and rear wheeled units 126 and 142 disposed within tracks 42, combine to generate a forwardly directed force on bearing link assemblies 26 which tends to augment the limited occupant input (i.e. pressure to seat back 16) required for causing substantially smoother operation of recliner 10. In addition, an over-center spring-loaded toggle assembly 180 is designed to selectively assist in driving leg rest assembly 20 between its respective "stowed" and "extended" positions.

With particular reference now to FIGS. 2, 3, 4, 8 and 9, bearing bracket assemblies 26 are shown to be operatively coupled to tilt linkage means 32 for "tilting" chair frame 12 relative to the floor upon movement of leg rest assembly 20. In general, tilt linkage means 32 interconnect the forward end of pivot levers 138 of bearing link assemblies 26 to drive assembly 32. More particularly, the forwardmost end of pivot levers 138 extend below and are generally aligned with the axis of drive rod 35 and are pivotally connected at pivot 219 to a lower end of a J-shaped toggle link 220. The other end of J-shaped toggle link 220 is pivotally connected to a connector link 222 at pivot 224 and which, in turn, is secured on drive rod 35 for angular movement therewith. Tilt linkage mechanisms 32 inhibit tilting movement of chair frame 12 until actuator lever 37 and, in turn, drive rod 35 are rotated for causing pivotal movement of pivot levers 138 relative to bearing links 124. More particularly, pivot levers 138 are formed with a lost motion slot 226 through which a rivet 228, extending through bearing link 124, moves to define a limited range of angular movement between pivot levers 138 and bearing links 124. Therefore, upon rotation of drive rod 35, the corresponding rotation of connector link 222 cause toggle link 220 to drive the forward end of pivot levers 138 downwardly. At this point, the mechanical advantage of tilt linkages 32 act to forwardly drive J-shaped toggle 220 around and below drive rod 35 so as to permit pivot levers 138 to pivot about pivot points 140 such that bearing link assemblies 26 and, in turn, chair frame 12 are "tilted" relative to tracks 42. In addition, rivet 228 provides structural support to chair 14 for maintaining the alignment and rigidity of pivot lever 138 for causing wheeled unit 142 to run straight within track 42. As such, lateral (i.e. side-to-side) cross-members can be eliminated since the rigidity of chair frame 12 is used to maintain correct wheel alignment to track 42.

As best seen in FIGS. 4 and 7, at least one spring-assist toggle assemblies 180 is provided which, as pointed out in U.S. Pat. No. 4,367,895, works coactively with leg rest pantograph linkages 28. Toggle assembly 180 provides means for holding leg rest assembly 20 tightly in a fully retracted (i.e., stowed) position against front brace structure 54 of chair frame 12 while also providing means for supplying a spring force for driving leg rest assembly 20 toward one of its extended positions. Toggle assembly 180 includes a toggle lever 230 with a square hole which is mounted by means of the square hole on square drive rod 35 for selective rotation therewith. Toggle lever 230 is pivotally connected at pivot 232 to front leg 234 of a C-shaped toggle link 236 that curves around, below and to the rear of drive rod 35 where its rear leg 238 has an opening in which one end of a helical coil spring 242 is hooked. The opposite end of spring 242 is hooked to a spring bracket 244 which is secured to secondary mounting bracket 130. Tension adjustment means, such as a plurality of holes 246 in mounting bracket 130, are provided for adjusting the tension in spring 242. For example, the tension in spring 242 can be adjustable relieved for a lighter weight occupant or it can be increased for a heavier seat occupant. Such adjustment means provide an extra comfort and convenience feature to reclining mechanism 10.

Operation of toggle assemblies 180 will now be described in greater detail. The location of pivot 232 below drive rod 35 and the line of action of spring 242 are such that in the retracted position of leg rest assembly 20, the spring force holds or "retains" leg rest assembly 20. As leg rest 20 is initially extended upon slight rotation of actuator lever 37 and, in turn, drive rod 35, pivot 232 moves up and over center of the drive rod axis. Once pivot 232 is over-center, tension loading on spring 242 assists in drivingly rotating drive rod 35 for elevating leg rest assembly 20 as rear leg 238 of link 236 is pulled toward secondary mounting bracket 130. In addition, spring 242 assists the occupant in pivoting handle 37 through the require actuation angle. Furthermore, toggle assembly 180 is adapted to utilize the spring biasing force of spring 242 to assist in returning leg rest assembly 20 to its stowed position upon reverse rotation of handle 37.

According to the operative principles of the present invention, leg rest assembly 20 and the associated tilting movement of chair frame 12 on base assembly 24 both occur upon selective angular movement of handle lever 37. Operation of the recline feature of reclining mechanism 10 and its associated tilting movement of chair frame 12 however, occur simply by weight shifting on the part of the seat occupant with no spring or lever assistance. When the chair occupant lets the weight of his or her back rest heavily against seat back frame 38, most of the load will be concentrated above pivots 76 so that rear swing links 74 plus seat back frame 38 become long lever arms that transform the pressure applied into forward motion of bearing link assemblies 26 in tracks 42 via actuation of push link mechanisms 30. To reverse this motion and return chair 14 to its upright position, the seat occupant simply leans forward to take his or her weight off seat back frame 38 and let that weight component be carried by seat frame 36. The weight balance provided by swing linkage 70 and tilt linkage 32 in conjunction with the load balancing due to the positioning of wheeled units 126 and 142 in tracks 42, enable the translational movements just described to be started, continued and terminated without the need for the seat occupant to push against chair arms 48 or any other forms of additional leverage.

Figure 10:
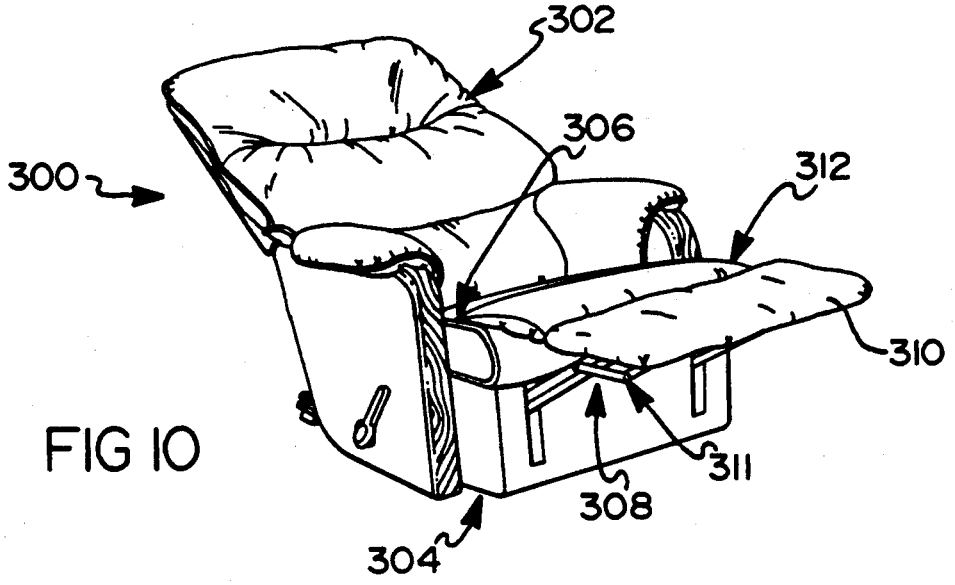
FIG. 10 is a perspective view of a chaise lounge recliner in accordance with a preferred embodiment of the present invention.
Figure 11:
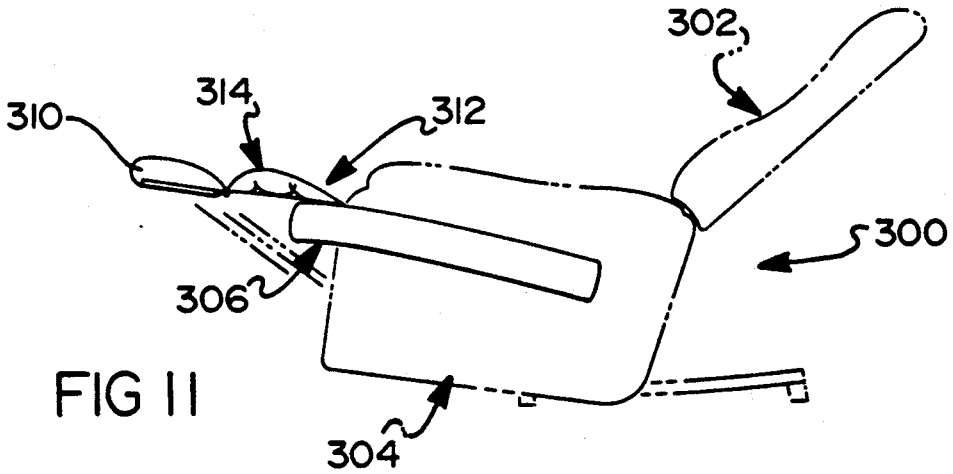
FIG. 11 is a side view of the leg rest member and intermediate leg support member of the chaise lounge recliner illustrating the pronounced convex shape which the intermediate leg rest member assumes when the seat member of the recliner is slidably extended.
Figure 12:
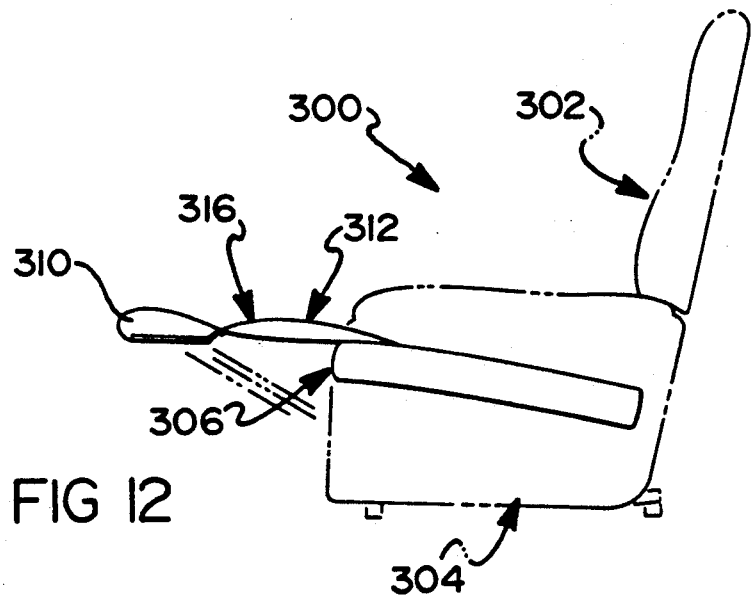
FIG. 12 is a side view of the leg rest member and the intermediate leg support member of the chaise lounge recliner illustrating the normal convex shape which the intermediate leg support member assumes when the seat of the recliner is in its retracted position.
Figure 13:
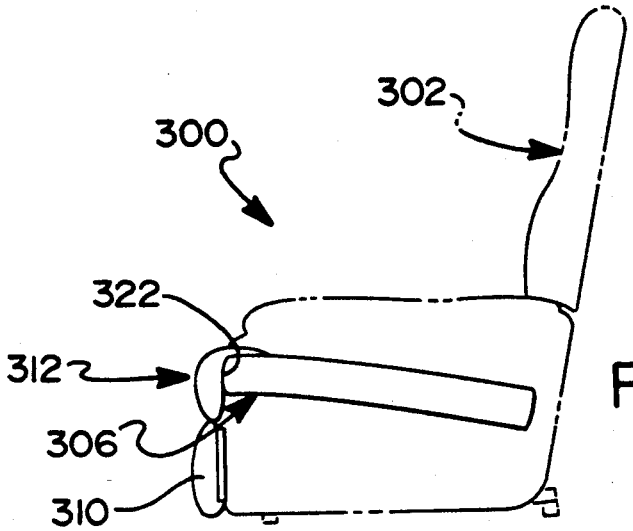
FIG. 13 is a side view of the leg rest member and intermediate leg support member when the leg rest member and seat of the recliner are in their retracted positions.

Referring now to FIGS. 10–17, a chaise lounge recliner chair 300 further in accordance with the teachings of the present invention is shown. As illustrated in FIGS. 10 and 13, the chair 300 generally includes a reclinable seat back member 302 which is operationally coupled as hereinbefore described with a chair frame 304, a slidably extendable and retractable seat member 306 and an extendable and retractable leg rest assembly 308 having leg rest member 310 and pantograph leg rest linkage assembly 311 for retractably extending leg rest member 310. Coupled inbetween a portion of the seat member 306 and the leg rest member 310 is an intermediate leg support member 312 of the present invention. The intermediate leg support member 312 preferably comprises a flexible, independent leg support cushion which is operable to assume a pronounced, convex shape when the chair 300 is in the reclined position shown in FIG. 10.

In FIG. 11 the pronounced convex shape, indicated by reference numeral 314, is more particularly illustrated. The convex shape 314 is assumed by intermediate support member 312 primarily due to the shortened distance between leg rest member 310 and the point at which the intermediate leg support member 312 is secured to seat member 306. The decrease in this distance can further be understood from FIG. 12, wherein the chair 300 is shown with the seat back member 302 in its upright position, the seat member 306 in its retracted position, and the leg rest member 310 in its extended or protracted position. In FIG. 12 it will be noted that the distance between leg rest member 310 and chair frame 304 is substantially the same regardless of whether seat member 306 is in its extended or retracted position and regardless of whether the seat back 302 is in its upright or reclined positions. Accordingly, since the leg rest member 310, when in its extended position, is held at a fixed distance relative to the chair frame 304, the outward extension of seat member 306 operates to shorten the distance between the points at which intermediate leg support member 312 is attached to the leg rest member 310 and to seat member 306. The extension of seat member 306 causes the portion of the intermediate leg support member 312 that is attached to seat member 306 to move toward leg rest member 310 and results in intermediate support member 312 assuming the pronounced convex shape 314 as illustrated in FIG. 11.

Referring briefly now to FIG. 13, the chair 300 is illustrated in its upright position with the leg rest member 310 fully retracted. In this position the intermediate leg support member 312 folds over an end portion 322 of seat member 306. Accordingly, intermediate leg support member 312 does not hamper the use of chair 300 as an upright chair, and an occupant may sit comfortably in the chair in an upright position without undue interference from support member 312.

When the seat back 302 is in its upright position and seat member 306 is in its retracted position with leg rest member 310 extended as shown in FIG. 12, the distance between the leg rest member 310 and seat member 306 is such that the intermediate leg support member 312 is stretched out and assumes its normal slightly convex shape, as indicated by reference numeral 316. The adaptability of the intermediate leg support member 312 to assume pronounced and slightly convex shapes 314 and 316, respectively, will be discussed in more detail in connection with FIGS. 16 and 17.

Figure 14:
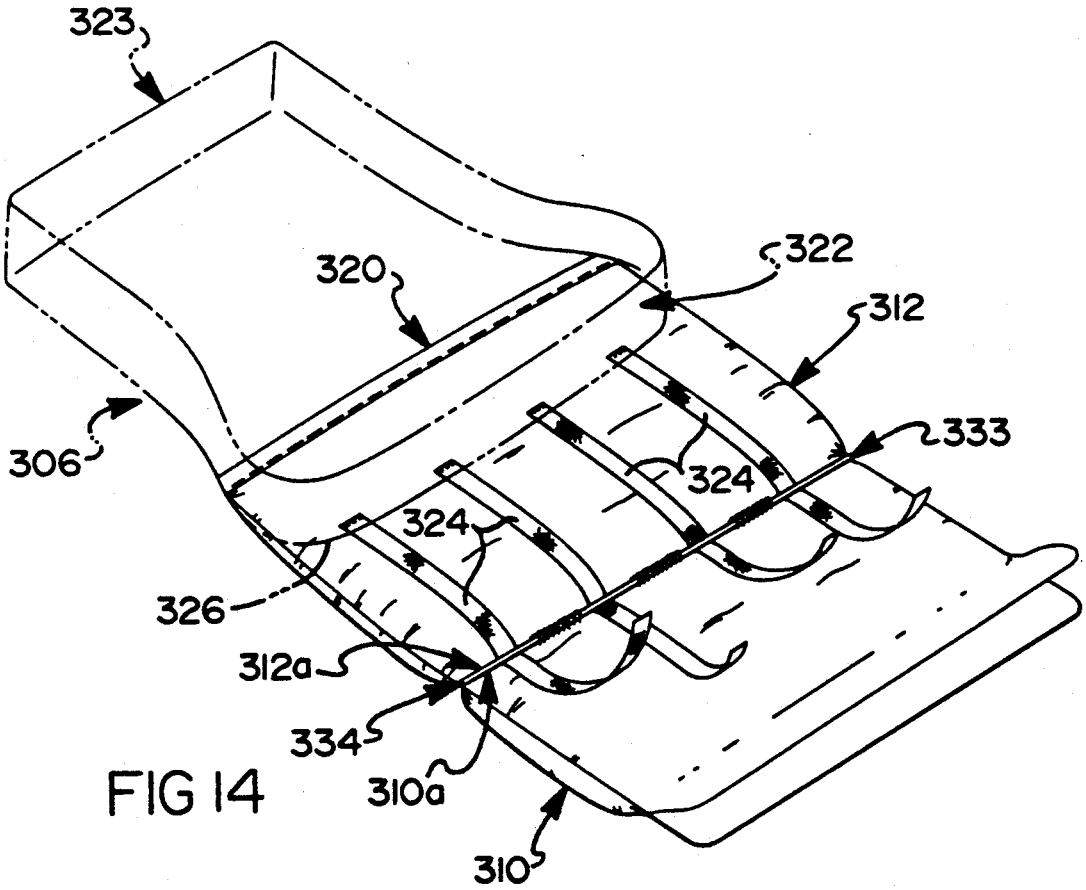
FIG. 14 is a perspective view of an undersurface of the intermediate support member and an undersurface of the leg rest member illustrating the plurality of independent elastic straps coupled inbetween the seat member (shown in phantom) and the leg rest member.
Figure 15:
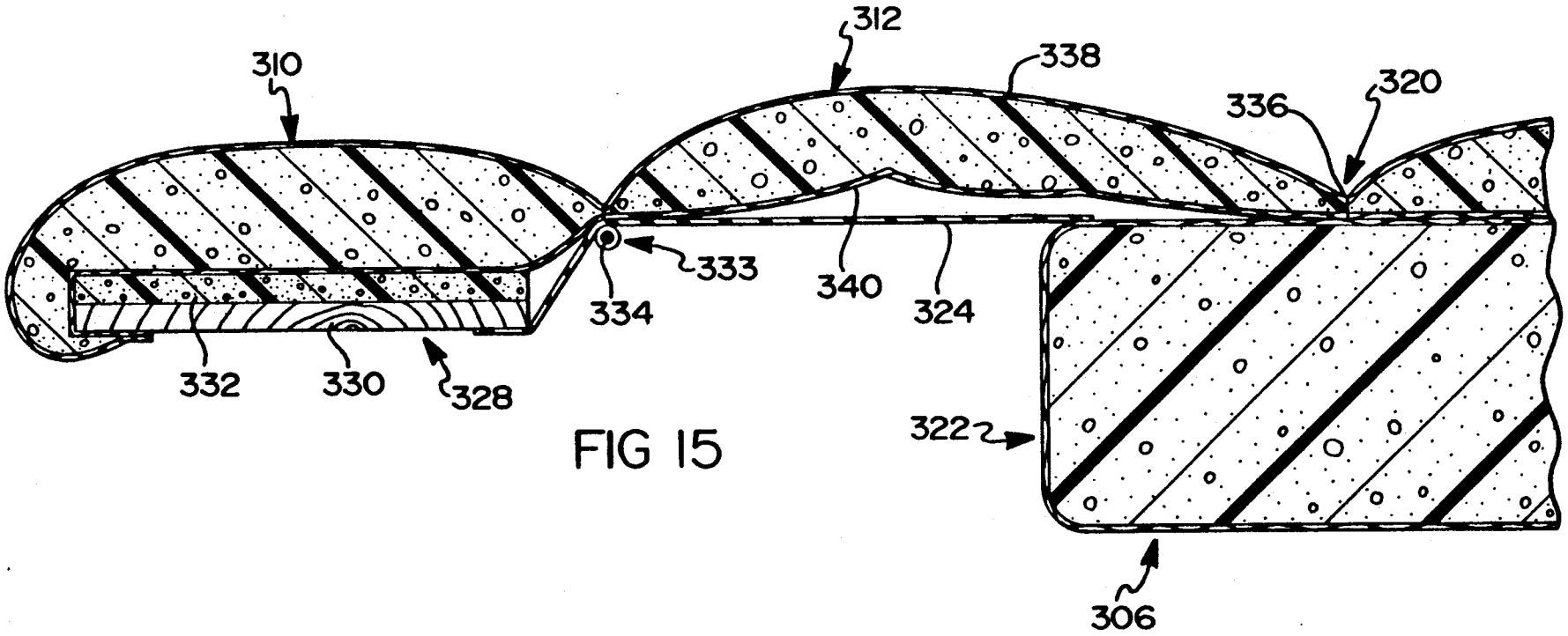
FIG. 15 is a cross-sectional side view showing more clearly the construction and interconnection of the intermediate leg support member as it is coupled inbetween a portion of the seat member and the leg rest member.

Referring to FIGS. 14 and 15, the intermediate leg support member 312 is coupled to an attachment area 320 of seat member 306 which is intermediate a front end portion 322 and a rear end portion 323 of the seat member 306. One end of a plurality of independent elastic straps 324 are fixedly secured such as by sewing to a front edge portion 326 of front end portion 322 of the seat member 306.

For providing further structural support to the intermediate leg support member 312, an elongated support wire 334 is included which extends generally transversely of the elastic straps 324, and, as shown in FIG. 14, is positioned over the straps 324. The support wire 334 is preferably a rigid 12 gauge wire and is secured to edge portions 312*a* and 310*a* of the intermediate leg support member 312 and leg rest member 310, respectively, which are defined by a seam which is denoted by reference numeral 333. The support wire preferably has a cloth covering and is secured to seam 333 by sewing to edge portions 312*a* and 310*a*. Support wire 334 enables the intermediate leg support member 312 to crown upwardly cleanly along seam 333 as the seat member 306 is moved slidably outwardly and inwardly during operation of the chair 300, and to help keep the intermediate leg support member 312 from collapsing downwardly as the seat member 306 is slidably extended.

A predetermined amount of stretching or tension is imparted to the free ends of the elastic straps 324 and, while in such tensioned state, the straps 324 are attached to support wire 334. The amount of tensioning that is imparted to the straps 324 is such that when the leg rest member 310 is extended and the chair 300 is in its upright position, there is sufficient tension in straps 324 to prevent intermediate support member 312 from crowning downwardly in a concave configuration when the seat member 306 extends forwardly as the chair moves between its upright and reclined positions. Even when chair 300 is in its fully reclined position a small amount of tension still is imparted to the elastic straps. In a preferred embodiment four laterally spaced elastic straps are provided, each strap being approximately 2" wide. The elastic straps 324 are secured to a base structure 328 of leg rest member 310 by staples, stitching or any other like method of attachment suitable to produce a secure attachment of the straps 324.

With reference to FIG. 15, the seat member is shown in the extended position. The intermediate leg support member 312 is coupled at connection area 320 with seat member 306 via an edge 336 portion of independent leg support member 312. Edge portion 336 comprises outer portion 338 and inner portion 340 of outer fabric material of the intermediate leg support member 312 which is coupled preferably by sewing, stitching or in a similar manner to seat member 306. This provides a particularly good attachment of the intermediate leg support member 312 to the seat member 306 to resist pulling and tugging as an occupant of the chair 300 moves about in the chair, and also when leg rest member 310 is urged into its fully retracted state.

Figure 17:
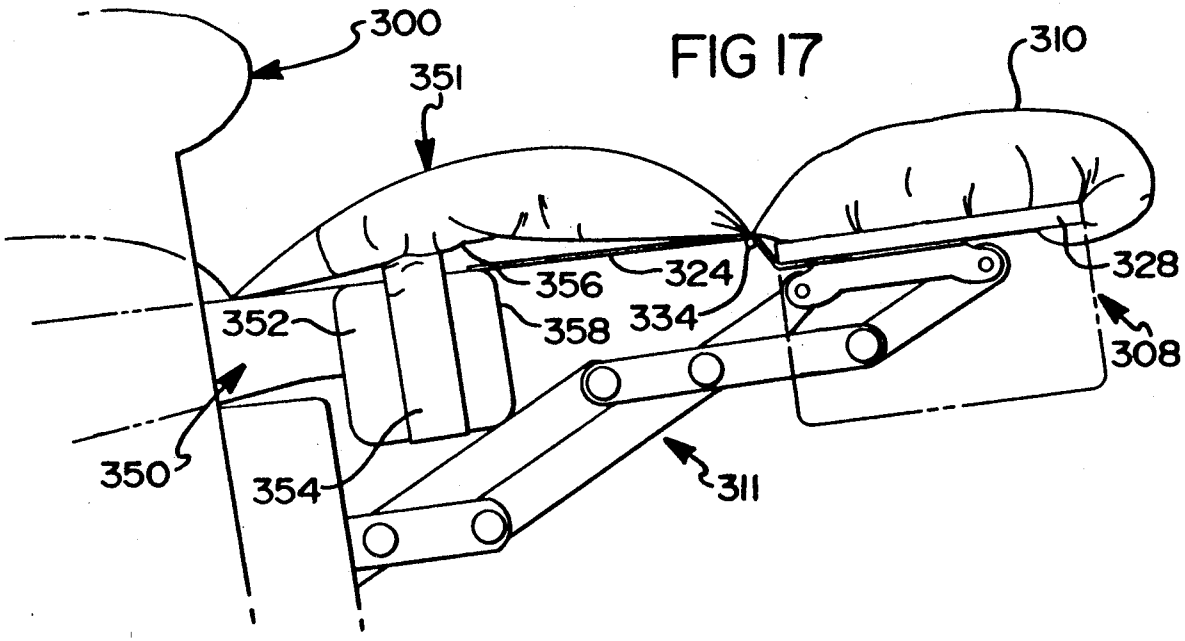
FIG. 17 is an elevational side view of intermediate leg support member illustrating the pronounced convex shape which it assumes when the leg rest member is in its extended position and the seat back and seat members (not shown) are in their reclined and extended positions, respectively.
Figure 16:
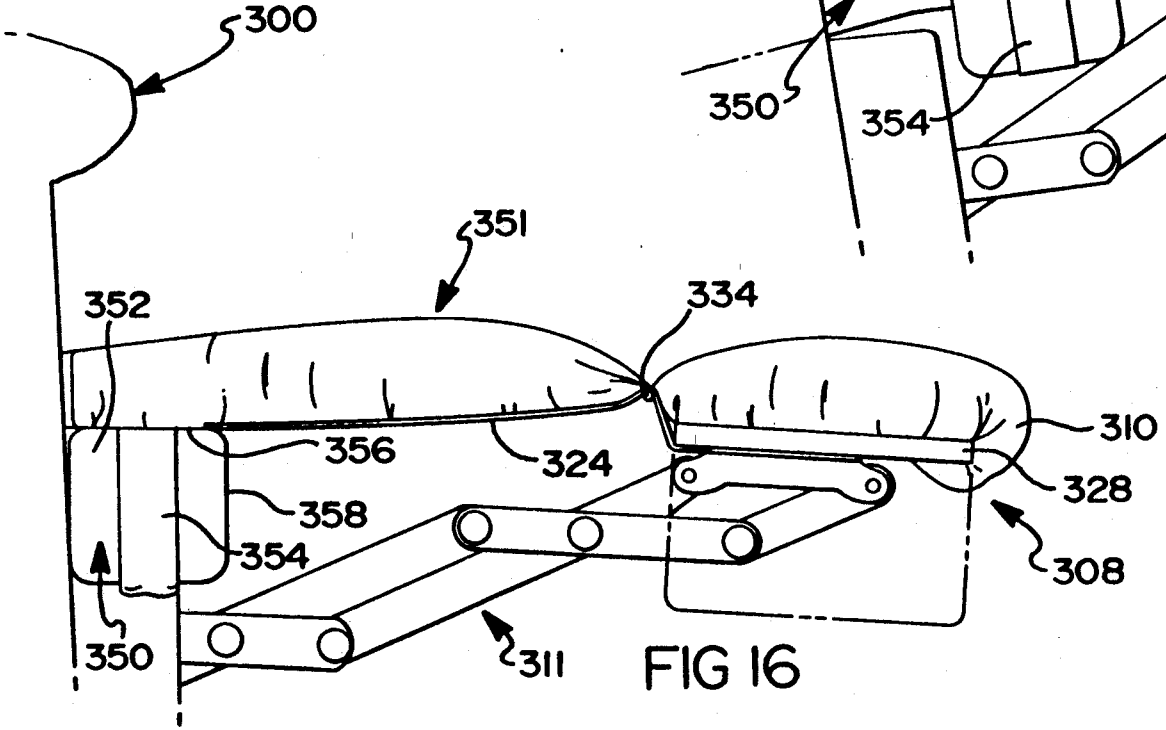
FIG. 16 is a side elevational view of the intermediate leg support member illustrating its normal convex shape when the leg rest member is extended and the seat back (not shown) is in an upright position.

FIGS. 16 and 17 further illustrate alternative preferred embodiments of a seat member 350 and an intermediate leg support member 351. In this embodiment the intermediate leg support member 351 comprises a T-shaped configuration, rather than the generally square configuration of intermediate leg support member 312. Seat member 350 similarly also comprises a T-shaped configuration and includes a T-shaped outer cushion portion 352 and a strap portion 354 secured thereto and also to an undersurface 356 portion of intermediate leg support member 351. The strap portion 354 is affixed to cushion portion 352 and to undersurface 356 of intermediate leg support member 351 preferably by sewing or stitching. Strap portion 354 is preferably of a width in the range of about ½–2½", and helps prevent intermediate leg support member 351 from being accidentally pulled upwardly during use of chair 300.

With further reference to FIGS. 16 and 17, it can be seen most clearly how the distance between leg rest member 310 and a front end portion 358 of the seat member 350 changes to cause the intermediate leg support member 351 to assume normal convex and pronounced convex shapes 316 and 314 respectively. When the seat back member 302 (not shown) is in its upright position, the seat member 350 is retracted and the distance between its front end 358 and the leg rest member 310 is at its maximum. At this point, the tension of elastic straps 324 is at a maximum to help prevent intermediate leg support member 351 from crowning downwardly relative to pantograph linkage assembly 311.

As the seat back 302 (not shown) is reclinably tilted backwards, the seat member 350 is slidably urged forwardly, thereby decreasing the distance between the front end 358 of seat member 350 and the leg rest member 310. The decreased distance causes the intermediate leg support member 351 to assume the pronounced convex shape 314 which serves to provide even further support to the back areas of the thighs and knees of the occupant.

In one embodiment of the chair 300, as best understood from FIG. 15, when the leg rest member 310 is extended and the seat member 306 is in the retracted position the intermediate leg support extends approximately 15" between the area 320 on the seat member 306 and the seam 333. The area 320 is approximately 7" back on seat member 306 from the front end portion 322, and the front end portion 322 is approximately 8" from the edge of the foot rest member 310 closest to seat member 306. When the chair 300 is in its fully reclined position and seat member 306 is in its most forwardly extended position the distance between area 320 and seam 333 is approximately 12"; i.e., it has shortened or decreased approximately 3". In this position, instead of being approximately 3½–4½" high in its normal convex configuration, intermediate leg support member 312 is approximately 4½–5½" high and has an increased thickness which combine to provide a greater mid-leg support force.

Accordingly, the intermediate leg support member 312 of the present invention is operable to provide varying degrees of support to the legs of an occupant of the chair 300 as the seat back member 302 is reclined. Thus, the chair 300 serves to provide continuous support from the upper back of the occupant to the feet in a manner similar to that of a chaise lounge, but with significant added control and adjustability not otherwise normally found with chaise lounge chairs.

Although the chair 300 will in many instances operate without any modifications to the reclining mechanism discussed hereinbefore, in some instances, depending upon the tension force which is created by the elastic straps 324 which are secured to the leg rest member 310 and seat member 306, it may be necessary to include additional counterbalancing force means in the form of springs or other like biasing means to help maintain the leg rest 310 in its extended position. If such is found to be the case, an additional spring such as spring 242 as shown in FIG. 7, as well as an additional spring bracket 244 and C-shaped toggle lever 236 may be included to provide additional biasing force to help hold the leg rest member 310 in its extended position.

While the intermediate leg support assembly of the present invention is also shown and described as part of the chair 300 which incorporates the wall proximity recliner mechanism described hereinbefore, it should also be appreciated that the chair 300 could be adapted to be a conventional recliner rocker-type of chair. One example of a rocker recliner chair 300 would utilize a swing linkage mechanism 70 to enable the seat member 306 to move substantially horizontally in relation to movement of the seat back 302 between upright and reclined positions. The only modifications, if any, that may be necessary to be made to such a rocker recliner chair 300 mechanism is that the amount of horizontal seat travel between upright and reclined positions may have to be adjusted to achieve the appropriate pronounced convex configuration of the intermediate leg support member 312 to provide adequate leg support to an occupant.

The chaise lounge recliner chair 300 of the present invention thus serves to provide an intermediate leg support member which crowns upwardly to provide additional support to the thighs and behind the knee areas of an occupant of the chair 300 when the leg rest is extended and the chair is in the reclined position. The chair 300 of the present invention thus provides increased comfort to an occupant of the chair without utilizing additional, loose pillows or the like.

The foregoing discussion discloses and describes an exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A chaise lounge recliner comprising:

a chair frame having a generally linearly movable seat member extendable, retractable leg rest member;

an intermediate leg support member coupled between and to said leg rest member and said seat member, said intermediate leg support member being operable to form a convex support surface having a variable degree of curvature; and means for enabling said seat member to be urged generally linearly toward said leg rest member, wherein movement of said seat member toward said leg rest member causes said intermediate leg support member to be urged from a first, convexly shaped support configuration into a second, convexly shaped support configuration, wherein said second convexly shaped support configuration has a greater degree of convex curvature than said first convexly shaped support configuration.

2. The chaise lounge recliner chair of claim 1, further comprising at least one elastic strap secured under tension intermediate an edge portion of said seat member and said leg rest member, said elastic strap extending generally longitudinally along an undersurface of said intermediate leg support member and being operable to provide support to said intermediate leg support member and maintain said variable convex shape when said leg rest member is in said extended position.

3. A chaise lounge recliner comprising:

a chair frame having a generally linearly movable seat member and extendable, retractable leg rest member;

an intermediate leg support member coupled between and to said leg rest member and said seat member, said intermediate leg support member being operable to form a convex support surface having a variable degree of curvature; and means for enabling said seat member to be urged generally linearly toward said leg rest member while said leg rest member is in a stationary, non-retracted position, wherein movement of said seat member toward said leg rest member while said leg rest member remains stationary in said non-retracted position causes said intermediate leg support member to be urged from a first, convexly shaped support configuration into a second, convexly shaped support configuration, wherein said second convexly shaped support configuration has a greater degree of convex curvature than said first convexly shaped support configuration.

4. A chaise lounge recliner chair comprising:

a chair frame having a reclinable seat back member, a seat member operationally coupled to said reclinable seat back member such that reclining of said seat back member causes said seat member to be urged slidably outwardly in a generally linear movement relative to said chair frame, and an extendable and retractable leg rest member, said seat member being slidably movable toward said leg rest member;

an intermediate leg support member coupled intermediate a portion of said seat member and said leg rest member; and means for causing said intermediate leg support member to assume a first convex shape relative to said seat member and provide support to the legs of an occupant of said chair when said leg rest member is in an extended position and said seat back member is in an upright position, said means also causing said intermediate leg support member to assume a second convex shape relative to said seat member when said leg rest member is in said extended position and said seat back member is urged into a reclined position, said second convex shape being operable to provide an increased degree of support to the legs of said occupant.

5. The chaise lounge recliner chair of claim 4, further comprising a plurality of elastic straps secured under tension to, and extending generally longitudinally intermediate of, an edge portion of said seat member and a portion of said leg rest member, said elastic straps being operable to help maintain said intermediate leg support member in said first and second convex shapes when said leg rest member is in said extended position and said seat member is slidably urged toward said leg rest member.

6. The chaise lounge recliner chair of claim 4, further comprising an elongated support wire secured to said plurality of elastic straps and extending generally transversely of said straps along a coupling seam formed by said coupling of said intermediate leg support member and said leg rest member.

7. The chaise lounge recliner chair comprising:

a chair frame;

a reclinable seat back member operationally coupled to said chair frame, said seat back member being operable to assume at least an upright position and a reclined position;

a seat member operationally coupled to said chair frame and said seat back member, said seat member being operable to assume a retracted position when said seat back member is in said upright position and to be urged slidably outwardly of said chair frame into an extended position in response to reclining of said seat back member into said reclined position;

an extendable leg rest assembly including a leg rest member operationally coupled to said chair frame and operable to be urged outwardly of said chair into an extended position and retracted into a retracted position;

an intermediate leg support member coupled to a portion of said seat member and a portion of said leg rest member, said intermediate leg support member having an upper surface operable to assume a slightly convex shape relative to said seat member when said seat member is in said retracted position and said leg rest member is in said extended position, said intermediate leg support member further being operable to assume a pronounced convex shape relative to said seat member when said seat member and said leg assemblies are in their respective extended positions; and a plurality of independent elastic straps secured intermediate an edge portion of said seat member and an edge portion of said leg rest member, said elastic straps being secured while under tension to thereby support a lower surface of said intermediate leg support member and thereby maintain said intermediate leg support member in said slightly convex and said pronounced convex shapes when said leg rest assembly is in said extended position.

8. The chaise lounge recliner chair of claim 7, further comprising an elongated support wire secured at a connecting seam formed by said coupling of said intermediate leg support member and said leg rest member, said elongated support wire extending generally transversely of said elastic straps to further provide structural support and rigidity to said intermediate leg support member when said leg rest assembly is in said extended position.

9. The chaise lounge recliner chair of claim 7, wherein the intermediate leg support member is operable to fold over a front end portion of said seat member when said leg rest assembly is in said retracted position.

10. The chaise lounge recliner chair of claim 7, wherein said intermediate leg support member comprises a flexible, intermediate leg support cushion.

11. The chaise lounge recliner chair of claim 10, wherein said flexible intermediate leg support cushion is secured by sewing to an upper surface of said seat member.

12. The chaise lounge recliner chair of claim 11, wherein said flexible intermediate leg support cushion is secured intermediately, to a portion of said seat member intermediate said edge portion of said seat member and a rear edge portion of said seat member.

* * * * *

UNITED STATES PATENT AND TRADEMARK OFFICE

CERTIFICATE OF CORRECTION

PATENT NO. : 5,156,441

DATED : October 20, 1992

INVENTOR(S) : Michael R. Byersmith and Larry P. LaPointe

It is certified that error appears in the above-identified patent and that said Letters Patent is hereby corrected as shown below:

On The Title Page, under "U.S. Patent Documents", reference 3,103,381; PTO Form 1449 mailed with Information Disclosure Statement dated 9/6/91, reference 3,103,381;
"10/1963" should be --9/1963--.

Col. 16, line 48 (Claim 1), Application Page 1, Line 4 (Claim 1), Amendment dated 4/6/92;
After "member" insert --and--.

Col. 18, line 3 (Claim 7), Amendment dated 12/4/91, page 2, reference to "In Claim 7, line 1";
"The" should be --A--.

Signed and Sealed this

Twenty-eighth Day of September, 1993

Bruce Lehman

*Attest:*

BRUCE LEHMAN

*Attesting Officer*

*Commissioner of Patents and Trademarks*